US008161675B2

(12) United States Patent
Sne et al.

(10) Patent No.: US 8,161,675 B2
(45) Date of Patent: Apr. 24, 2012

(54) AIMING DEVICE AND METHOD FOR GUNS

(75) Inventors: Yakon Sne, Tiberias (IL); Ptal Gal, Kibbutz Degania B. (IL)

(73) Assignees: Yakov Sne, Tiberia (IL); Ygal Abo, Tiberias (IL)

( * ) Notice: Subject to any disclaimer, the term of this patent is extended or adjusted under 35 U.S.C. 154(b) by 901 days.

(21) Appl. No.: 11/579,996

(22) PCT Filed: May 9, 2005

(86) PCT No.: PCT/IL2005/000486

§ 371 (c)(1),
(2), (4) Date: Feb. 21, 2007

(87) PCT Pub. No.: WO2005/109306

PCT Pub. Date: Nov. 17, 2005

(65) Prior Publication Data

US 2007/0214699 A1 Sep. 20, 2007

(30) Foreign Application Priority Data

May 10, 2004 (IL) ..... 161911

(51) Int. Cl.
*F41G 1/00* (2006.01)

(52) U.S. Cl. ..... 42/111; 42/132; 42/145

(58) Field of Classification Search ..... 42/111, 42/132, 145

See application file for complete search history.

(56) References Cited

U.S. PATENT DOCUMENTS

| | | | | | |
|---|---|---|---|---|---|
| 1,433,422 | A | * | 10/1922 | Spencer | 42/140 |
| 2,420,252 | A | | 5/1947 | Land | |
| 2,420,273 | A | * | 5/1947 | West | 359/498 |
| 2,498,706 | A | * | 2/1950 | Pease et al. | 42/111 |
| 2,553,540 | A | | 5/1951 | Beckerman | |
| 2,706,335 | A | * | 4/1955 | Munsey | 42/145 |
| 3,187,436 | A | * | 6/1965 | Friedrichsmeier | 42/137 |
| 3,362,074 | A | * | 1/1968 | Luebkeman et al. | 42/144 |
| 3,949,482 | A | * | 4/1976 | Ross | 42/120 |
| 4,070,763 | A | * | 1/1978 | Carts, Jr. | 42/132 |
| 4,272,191 | A | * | 6/1981 | Bergkvist | 356/153 |
| 4,616,421 | A | * | 10/1986 | Forsen | 42/130 |
| 4,745,698 | A | * | 5/1988 | Schwulst | 42/132 |
| 5,065,519 | A | * | 11/1991 | Bindon | 42/145 |
| 5,359,800 | A | | 11/1994 | Fisher et al. | |
| 5,862,618 | A | * | 1/1999 | Brown | 42/145 |
| 6,233,836 | B1 | * | 5/2001 | Uhlmann et al. | 42/145 |

(Continued)

OTHER PUBLICATIONS

International Preliminary Report on Patentability for corresponding PCT application—7 pages. Supplementary Partial European Search Report for corresponding EPO patent application; 4 pages; mailed on Sep. 21, 2010.

*Primary Examiner* — Michelle Clement

(74) *Attorney, Agent, or Firm* — Ranch Brown McCarthy & Gruber, P.C.; Kevin D. McCarthy

(57) ABSTRACT

An aiming device for guns, which comprises a transparent plate that shows to the user a critical image when the plate has a predetermined orientation, and shows a deformed image when said plate has any other different orientation. The transparent plate is so mounted in the device and the device is so mounted on the gun, such that the critical image is seen by the user when and only when the axis of the gun barrel is parallel to the line of sight passing through the user's eye and the center of the transparent plate.

26 Claims, 7 Drawing Sheets

U.S. PATENT DOCUMENTS 6,321,479 B1 * 11/2001 Sheehan ..... 42/111
6,360,472 B1 * 3/2002 Lorocco ..... 42/132
6,604,315 B1 8/2003 Smith et al.
6,802,131 B1 10/2004 Scholz et al.
6,865,022 B2 * 3/2005 Skinner et al. ..... 359/428
6,868,615 B2 * 3/2005 Malley ..... 33/297
6,967,775 B1 11/2005 Millett

* cited by examiner 35
32
34
37
36
32
33

35
32
34
33
36
31

18
36
30
31
16
14

AIMING DEVICE AND METHOD FOR GUNS

CLAIM OF PRIORITY

This application is a continuation-in-part application of published international patent application number PCT/IL2005/000486, filed on May 9, 2005; which claims priority to Israeli patent application number 161911, filed on May 10, 2004.

FIELD OF THE INVENTION

This invention relates to devices for aiming hand-held guns, such as pistols and revolvers, and in general fire arms, including short range rifles. The devices of the invention permit particularly quick and accurate aiming of the fire arm and substantially eliminate subjective aiming errors. The invention also comprises a corresponding aiming method.

BACKGROUND OF THE INVENTION

Fire arms, particularly hand-held fire arms are conventionally aimed by aligning a front sight with a rear sight and pointing the front sight to the target point. The term "short range", as used herein, includes ranges which are up to about 30 m for pistols and about 50 m for other types of firearms. By "target" is meant the object or person that the shooter intends to hit, and by "target point" is meant the point of the target at which the shooter aims the projectile.

Generally the projectiles may hit any point within an area about the target point, but if the shooting is good, said area will be limited. When the front and the rear sight are aligned, they define a line that will be called "the aim line", and when said aim line passes through the shooter's aiming eye, the axis of the fire arm barrel should be directed to the target point.

The conventional system of aiming involves certain inherent errors: a) the aim line is spaced by a few millimeters from the barrel axis, whereby the point of impact of the projectile, assuming that there are no other errors, will be equally spaced from the point at which the shooter aimed (this may be called "the parallax error"; b) an attempted compensation of the resulting error by structuring the sights so as to slant the aim line slightly towards to the barrel axis, is effective only if the target is located at the distance at which the aim line and the barrel axis meet, and if it is not, said error will remain and may even be increased; c) the fire arm's sights mask, to some extent, the target; d) gun users that are not too experienced require some time to aim by aligning the two sights; e) the alignment of the sights is not objective and its accuracy depends on the skill of the gun user.

U.S. Pat. No. 6,604,315 B1 discloses and claims an aiming apparatus which comprises a first and a second lenticular element, orthogonal to one another, both mounted on the barrel of the gun, wherein the first lenticular element receives a first image when the shooter's aiming eye is in proper alignment with said barrel in elevation and a second image when the shooter's aiming eye is not in proper alignment in elevation, and the second lenticular element receives a third image when the shooter's aiming eye is in proper alignment with said barrel in azimuth and a fourth image when the shooter's aiming eye is not in proper alignment in azimuth. The first and third image are of a first matching color, typically green, and second and fourth image are of a second matching color, typically red. Said apparatus is not fully satisfactory, firstly because it comprises two lenticular elements and is therefore somewhat complicated and costly; secondly, because its user has to rely on the accurate perception of colors that may not be quite distinctive to him and anyway are not easy to distinguish in dark or sharply colored environments; and thirdly, because it requires the user to correct the alignment of the gun barrel by moving it in two orthogonal directions, elevation and azimuth, a requirement which slows down the aiming and renders it uncertain, since a correction in elevation may be accompanied by a displacement in azimuth, and vice versa.

Co-pending patent application No. 155993, the contents of which are incorporated herein by reference, describes and claims an aiming device for short range guns, which comprises an aiming sight for directing the aim to the target, mounted on the barrel near its forward end, and an angle indicator, for signaling when the aim line is at a predetermined angle, preferably parallel, to the axis of the gun barrel. The angle indicator, which typically comprises two like elements symmetrically positioned about the aiming sight, comprises one or more figures lying on a plane that makes a given angle to the gun barrel axis and some means for determining when the aim line passing from the gun user's eye and the aiming sight makes said given angle to the plane of said figure, or forms with said plane a predetermined, compensation angle. Typically, said figures lie on a plane perpendicular to the axis of the gun barrel and acquire a distinctive appearance when viewed along an aim line perpendicular to said plane.

The said co-pending application also describes and claims an aiming method for short range guns provided with said aiming device, wherein the gun user firstly brings the tip of the aiming sight in the appropriate position with respect to the target point, which can be called a coarse aiming step, and thereafter completes the aiming by gun to by bringing the aim line to a predetermined angle to the axis of the gun barrel while keeping the aiming sight in the said appropriate position, which can be called a fine aiming step.

Types of images or figures forming part of the angle indicator include figures, preferably colored, and which may be transparent, which look deformed in some way from a basic shape when seen at an angle; images which change according to the angle under which they are seen, e.g. by changing color or showing or hiding predetermined shapes or details; and composite figures, including at least two parts of different colors, wherein one part is seen as larger and the other as smaller, depending on the angle at which the figure is seen.

While the aiming device of said co-pending application constitutes an important improvement over the prior art, it still comprises two components—the aiming sight and the angle indicator—and requires two aiming steps—a coarse and a fine one. Because of this, on the one hand, the aiming is not as easy and immediate as might be desired, and subjective errors are not completely eliminated.

It is therefore a purpose of this invention to provide an aiming device for guns, particularly, but not exclusively, short range hand-held guns, for instance pistols and revolvers, that is extremely simple and reliable.

It is another purpose to provide such an aiming device which consists of a single structural element.

It is a further purpose to provide such an aiming device which substantially eliminates subjective errors.

It is a still further purpose to provide such an aiming device which does not define nor require two displacements in two directions to render the aiming line parallel to the gun barrel axis.

It is a still further purpose to provide an aiming method which permits very accurate aiming with extreme rapidity.

It is a still further purpose to provide an aiming method which is completed in a single step.

It is a still further purpose to provide an aiming method which does not require to establish an optical correlation between different structural element, but only requires the observation of a single element.

Other purposes and advantages of the invention will appear as the description proceeds.

SUMMARY OF THE INVENTION

The present invention is directed to an aiming device for guns, such as rifles, firearms, toy guns, PaintBall guns and any gun that is intended to shoot a real, dummy or virtual projectile of any shape to a target.

The aiming device comprises one or more transparent plates, which shows to a person aiming the gun (hereinafter, "the user" or "the shooter") an image that has a critical optical appearance (hereinafter, "the critical image") when a plane associated with said plate has a predetermined orientation, and shows a different image (hereinafter, "the deformed image") when said plate has any other different orientation; wherein said transparent plate is so mounted in said indicator and said indicator is so mounted on the gun to be aimed that said critical image is seen by the user when and only when the axis of the gun barrel is parallel to the line of sight passing through the user's eye and the center of said transparent plate.

The term "plate", as used herein, does not necessarily mean a planar element. The plate may be curved, e.g. a cylindrical or tubular element. The "plane associated with said plate" may be defined in any way, e.g. may be the plane tangent to the center of the plate or the plane on which lies the periphery of the plate. Hereinafter, for brevity's sake, the plate will be assumed to be planar, but no limitation is intended by this, and what is said about the plate will be applicable, if said plate is not planar, to said plane associated with said plate. In the following description and claims, the term "plate" will be used, for brevity's sake, to include, where appropriate, the plane associated with the plate.

The aiming device will generally comprise, in addition to the transparent plate, a support for said plate, through which the plate is mounted on the gun with the appropriate orientation. The transparent plate, whether planar or not, is preferably, though not necessarily, circular, and in that case, said support is ring-like or comprises a ring-like frame portion.

Preferably, the structure of the plate support, the way in which the plate is mounted therein, and the way in which said support is mounted on the gun, generally but not necessarily on the gun barrel, are such the plate is perpendicular to the axis of the gun barrel, and the image shown by the plate to the user is the critical image when the line of sight from the user's eye to said image is perpendicular to said plate. Therefore, when the user sees the critical image, he knows that the gun barrel is parallel to his line of sight, and if his line of sight passes through the target point, the gun is properly aimed.

The one or more transparent plates is preferably provided with— i. an image projection source;

ii. light exit means, through which a user views an image projected from said image projection source and configured with a major axis dimension essentially equal to that of said image projection source; and iii. a characteristic length between said image projection source and said light exit means.

A critical image appears in said light exit means when said plate has a predetermined orientation such that the axis of the gun barrel is parallel to the line of sight passing through an eye of the user and a center of said light entry means, and a deformed image appearing in said light exit means when said plate has an orientation other than said predetermined orientation and the object projected from said image projection source is partially obstructed by a wall of, or enclosing, said one or more transparent plates.

Said major axis dimension and said characteristic length define a predetermined transition sharpness from said deformed image to said critical image, the relative location of said deformed image with respect to said light exit means being indicative of the direction of deviation of the line of sight from the gun barrel axis.

The aiming method, when the aiming device of the invention is used, is a single step one. The user points the gun in such a way that he sees the critical image and the target point at the center of the transparent plate. In preferred embodiments, the critical image covers the entire surface of the transparent plate, and therefore the center of the transparent plate is also the center of the critical image. Since both the plate and the image are small, having, if circular, a diameter from 3 to 10 mm and preferably from 4 to 6 mm, accurately placing the target point at their center is very easy. Of course, it is also possible to mark the center of the plate by an insert, or by a preferably black dot, or by other marks examples of which will be given hereinafter.

The invention, therefore, also includes an aiming method which consists in generating the critical image and bringing the target point to the center of said image.

The aiming method preferably comprises the following steps:

a) providing one or more curvilinear transparent plates supported by a gun barrel, said one or more transparent plates having— i. an image projection source;

ii. light exit means through which a user views an image projected from said image projection source and configured with a major axis dimension essentially equal to that of said image projection source; and iii. a characteristic length between said image projection source and said light exit means;

b) aiming the gun at a selected target so that an image of at least a portion of said selected target is visible in said light exit means, a critical image appearing in said light exit means when said plate has a predetermined orientation such that the axis of the gun barrel is parallel to the line of sight passing through an eye of the user and a center of said image projection source, and a deformed image appearing in said light exit means when said plate has an orientation other than said predetermined orientation and the object projected from said image projection source is partially obstructed by a wall of, or enclosing, said or more transparent plates; and c) if said visible image is a distorted image, changing the orientation of said one or more plates by displacing said barrel in a direction parallel to a line passing through said distorted image and a center of said light exit means until said critical image appears in said light exit means, wherein said major axis length and said characteristic length define a transition sharpness from said deformed image to said critical image.

Examples of colored materials that can be used in a transparent plate of the invention are, for instance: phosphorus materials, fluorescent materials organic or biological luminous materials (such as luminous materials produced by insects, e.g., fireflies, by underwater creatures, or by plants), radioactive luminous materials, e.g., Tritium (see U.S. Pat. No. 5,359,800, U.S. Pat. No. 5,065,519, and night sights made by Trijicon Inc., Farmington Hills, Mich., U.S.A.), and lenticular indicia sets (described, for example, in "Lenticular Imaging, Part I", Screen Graphics, September/October 1999, pp 37-42 and in "Lenticular Imaging, Part II", Screen Graphics, January/February 2000, pp 30-35, in "Lenticular Imaging, Part III", Screen Graphics, March/April 2000, pp 30-36). It should be understood, however, that in the broad definition of the invention, are comprised the passage of the image shown by the transparent plate from a colorless to a colored condition or vice versa, and therefore, in this invention, the term "color" may comprise the colorless state.

DETAILED DESCRIPTION OF PREFERRED EMBODIMENTS

Figure 1A:
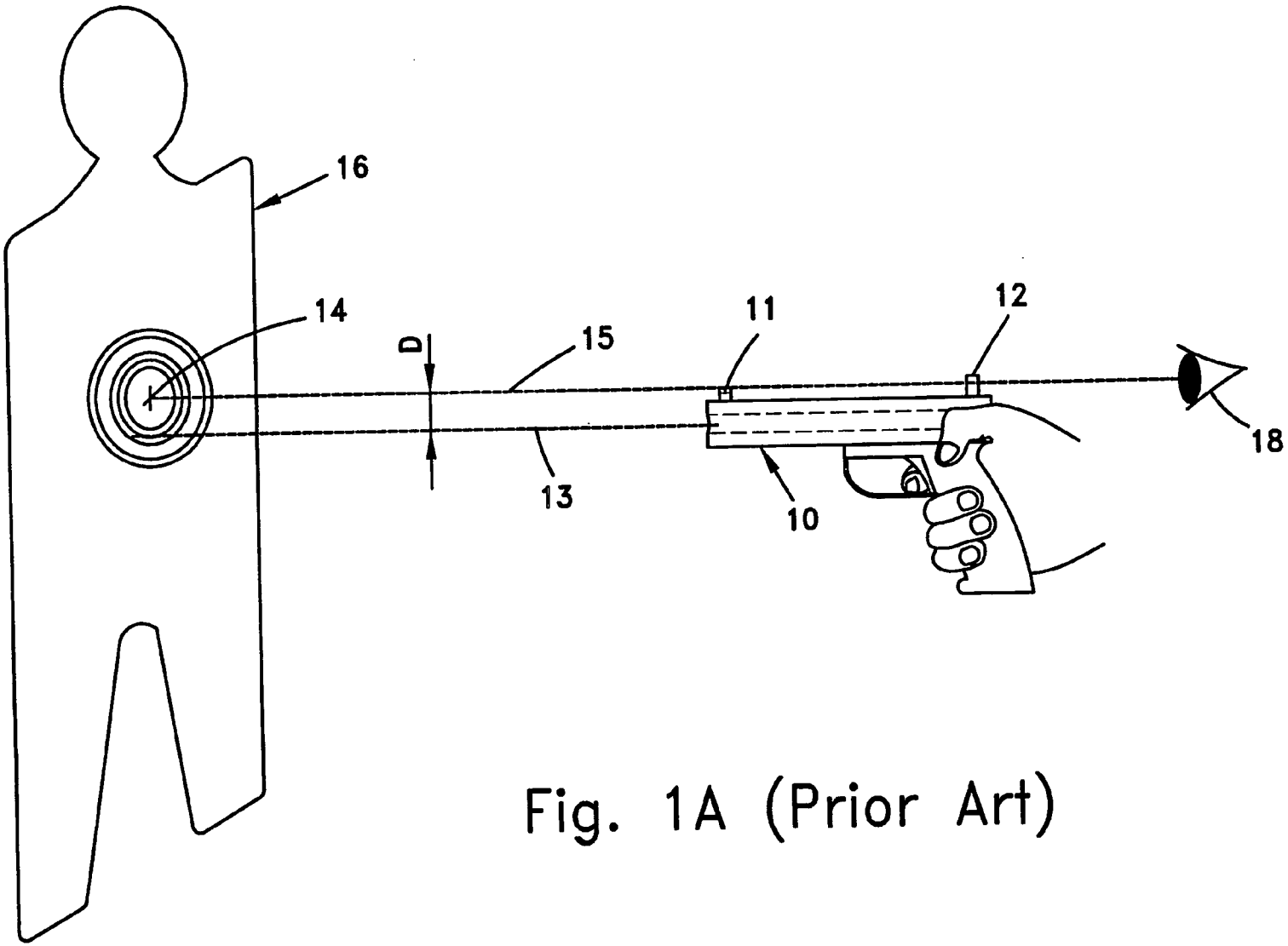
Fig. 1A (Prior Art)
FIGS. 1A and 1B schematically illustrate the conventional aiming devices and procedure.
Figure 1B:
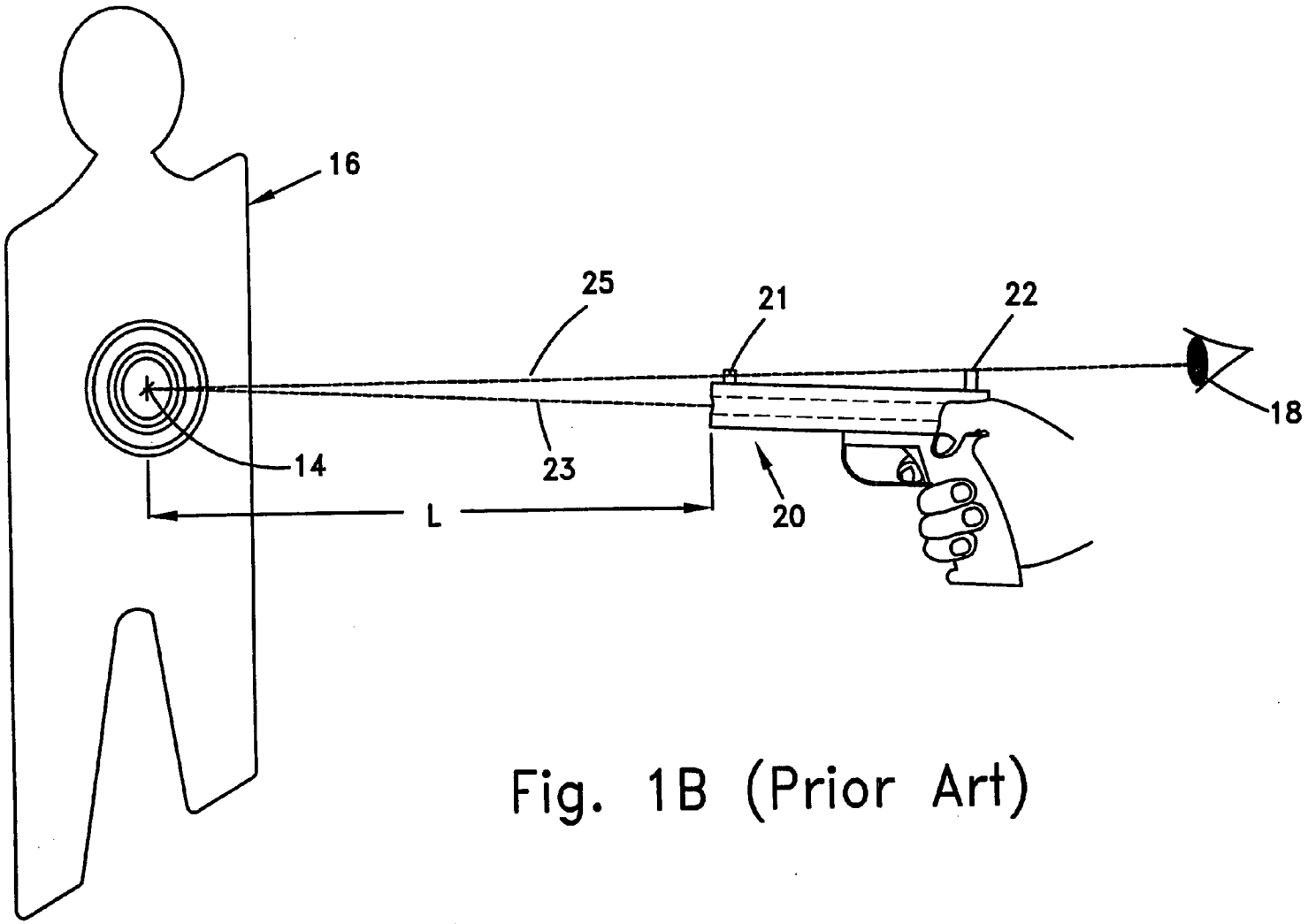
Fig. 1B (Prior Art)

FIG. 1 schematically shows in perspective view a conventional prior art aiming device and method. A hand-held gun 10 is represented as a pistol. Numeral 18 generally indicates the eye of the gun user. It is well known that even if a shooter aims with both eyes, his brain selects one eye as the aiming one and therefore it is permitted in this description to refer to the shooter's eye in singular. The aiming device comprises a front sight 11 and a rear sight 12. Numeral 16 symbolically indicates a target, wherein 14 is the target point. The aim line of sight 15 passes from the shooter's eye 18 through sights 11 and 12, and, when the gun is aimed, impacts on the target point 14. Actually, as has been said, an experienced shooter will correct for the distance between the line passing through sights 11 and 12 and the gun barrel axis, and therefore he will so aim that the aim line 15 impacts the target slightly above the target point 14. Of course, the actual trajectory of the projectile curves downwards, because of the gravity effect, and therefore, if the resulting deviation of the projectile from the aim line 15 is significant, an experienced shooter will know it and will correct for it, this correction being sometimes more substantial than that required by the distance between the aim line and the gun barrel axis. This correction is illustrated in FIG. 1B.

In both of the prior art cases of FIG. 1A and FIG. 1B, the physical arrangement of the front and rear sights is familiar to all skilled persons and need not be described. In general, the rear sight is fork-shaped and the front sight is brought, when aiming, to the central part of the fork and ideally in the middle, for lateral aiming, and at the same height as the rear sight, for vertical aiming.

Figures 2A, 2B, 2C:
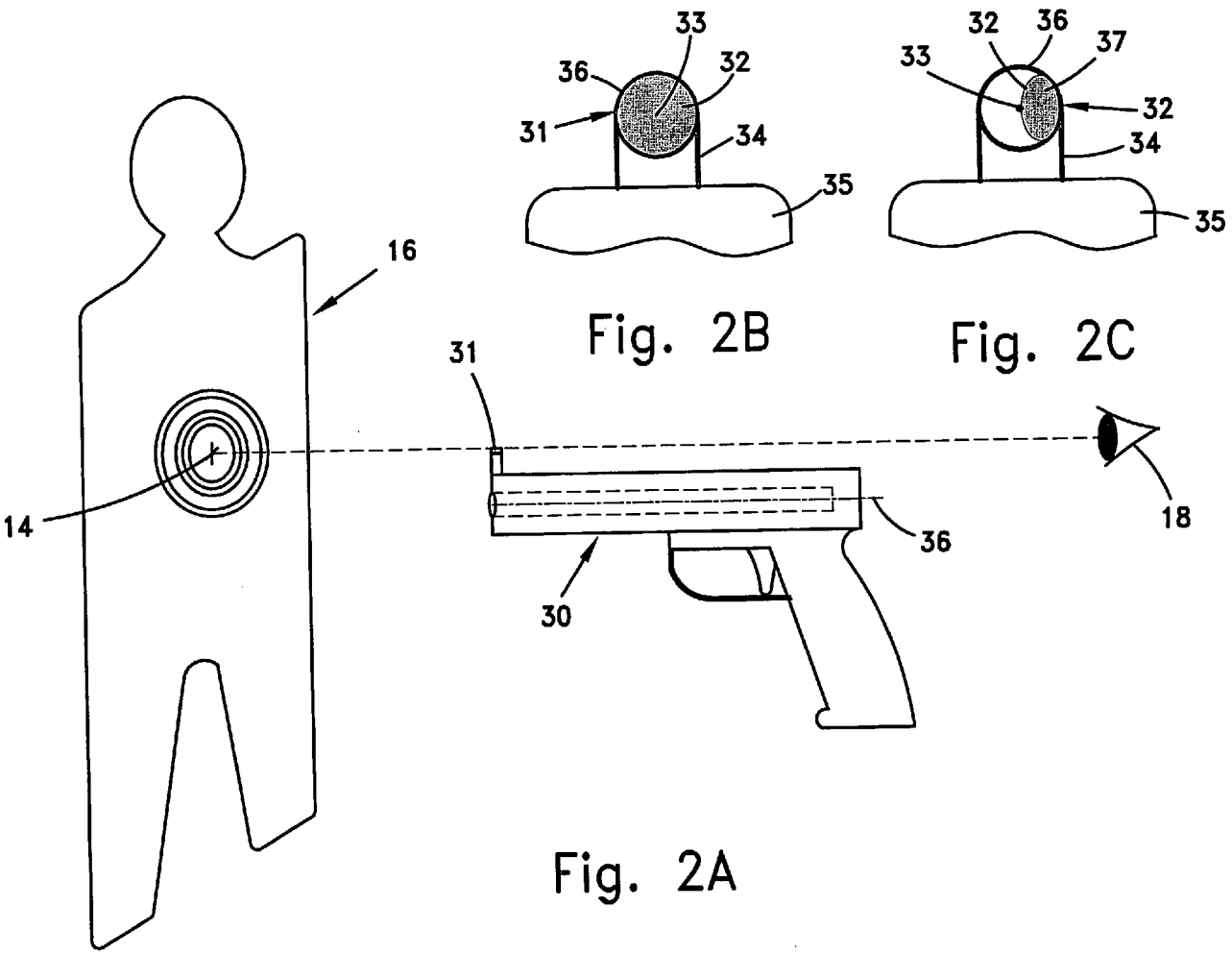
FIG. 2A is a schematic perspective illustration of an embodiment of the invention in the aiming of a gun shown as a pistol, but which my be a revolver, a rifle or any other gun.
FIGS. 2B and 2C are vertical views from the rear of the transparent plate of said gun, wherein in FIG. 2B the gun is properly aimed and in FIG. 2C the gun is not properly aimed.

FIGS. 2A to 2C illustrate a first embodiment of the invention. The target is again indicated at 16, the target point at 14, and the gun user's aiming eye at 18, as they will be in the following figures. The gun is illustrated as a pistol 30, but this embodiment of the invention, like all embodiments of the invention, is equally applicable to all kinds of, particularly but not exclusively short range hand-held guns, including in particular short-range rifles. Gun 30 is provided with an aiming device 31. No rear sight is provided.

A preferred embodiment of the aiming device is shown in FIG. 2B, in which said device is shown as the user sees it when correctly aiming the gun, viz. is seen in vertical view from the rear. Numeral 32 indicates a transparent plate, which in this embodiment is planar and round. The plate is seen as colored and to represent this it is shown as gray in the drawing, but in reality it may have any chosen color, for instance red or blue, said color being preferably pale not to interfere with a clear view of the target. 33 is the target point, and it is seen at the center of the transparent plate. 34 indicates a support in which plate 32 is mounted, which support or frame is mounted on the gun barrel, of which only a broken off portion 35 is shown in the drawings. The support 34 in this embodiment comprises a round central frame 36 and is so structured that it holds the plate 32 perpendicular to the gun barrel axis. Therefore in the position shown in FIG. 2B the gun barrel axis is parallel to the line of sight from the user's eye to the target point.

The aiming device 31 is shown in FIG. 2C as it appears to the user when the gun is not correctly aimed. It is seen that colored shape 37, which may be called the "deformed shape", which has the same color as in FIG. 2B and is equally shown in the drawing as gray, does not occupy the whole round area of transparent plate 32 but only a portion of it, and therefore the gun barrel axis is not parallel to the line of sight from the user's eye to the target point and the gun is not correctly aimed. The user will shift the gun until the situation of FIG. 2B is produced.

The deformed shape is shown in FIG. 2C as being oval and set at one side of the transparent plate. However, this is only an example and the deformed shape may have any form and size, and be set at any zone of the transparent plate, as long as it is easily, and preferably immediately, recognizable by the user. Generally, it would be sufficient, to render it recognizable, that it should cover only a part of the transparent plate as seen, for example, in FIG. 2C. Any deformed shape, therefore, is included in this invention.

In FIGS. 2B and 2C the user judges when the target point is seen at the center of the transparent plate. This is easy, since said plate has a small size. However, it is possible within the scope of the invention to mark precisely or approximately the center of the plate. FIGS. 3A to D, which are vertical views like FIGS. 2B and 2C, show various ways of marking said center.

Figure 3A:
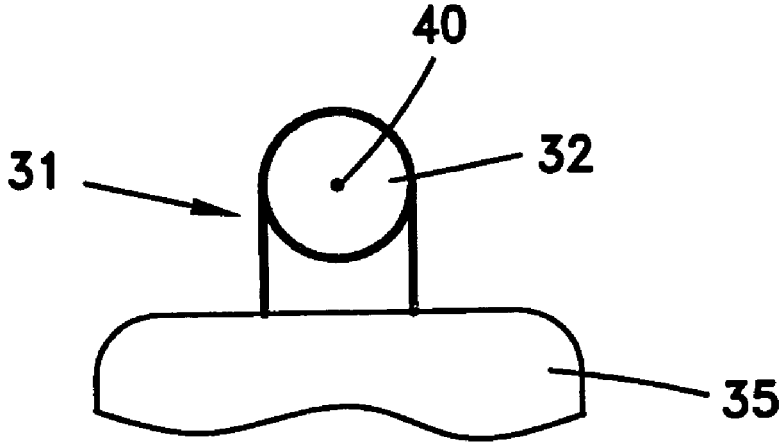
FIGS. 3A to 3D show various different embodiments of the transparent plate according to embodiments of the invention.
Figure 3B:
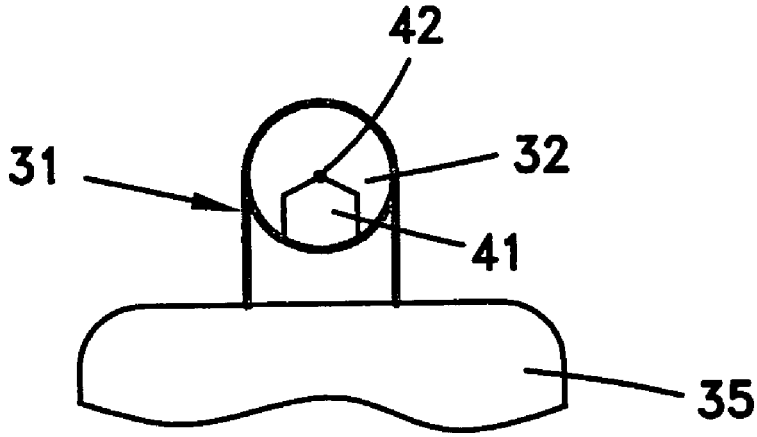
Figure 3C:
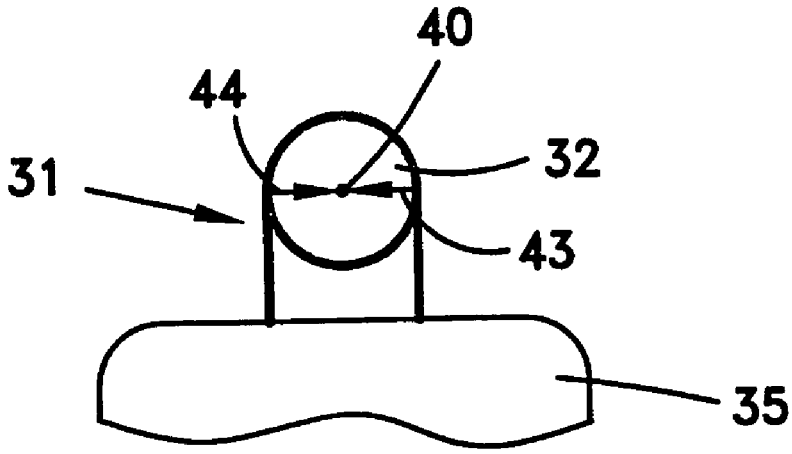
Figure 3D:
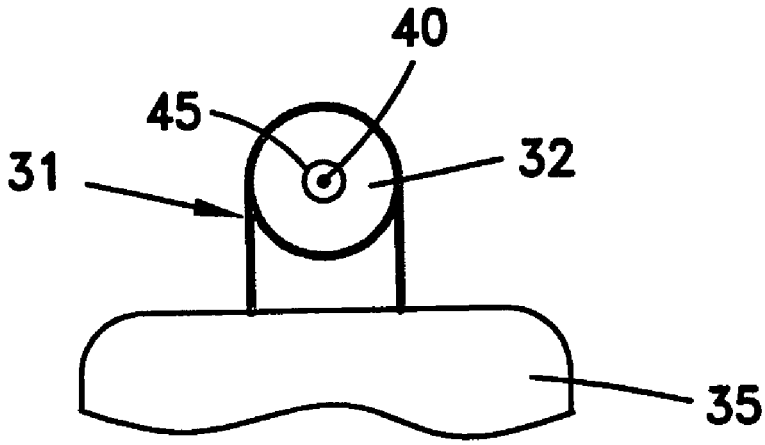

In FIG. 3A the center 40 of the transparent plate is indicated by a mark, which in this example is a dot, generally as black dot. In FIG. 3B a figure 41, similar to a conventional front sight, indicates said center by its tip 42. In FIG. 3C two arrows 43-44 are aligned with said center and leave only a small space between them, said center being located in said small space. In FIG. 3D a very small circle 45 is marked, the center 40 of the transparent plate being the center of said circle. Other ways to facilitate the identification of the center of the transparent plate can easily be devised by skilled persons.

It will be apparent that, while the transparent plates that have been illustrated are planar and round, this is not necessary. Other structures of transparent plates could be adopted in all embodiments of the invention, but they should always be such that it will be readily apparent when the images which they show are seen properly and when they are seen deformed. Particularly, the deformation may consist in the disappearance or appearance of images or of portions of images. Thus, in the examples described the transparent plate appears wholly and equally colored when the line of sight from the user's eye to the target point is parallel to the gun barrel axis, and only partly colored when said line of sight is not so parallel, but the opposite could be true, viz. a total or partial coloration might be generally seen by the user and disappear only when the line of sight from the user's eye to the target point is parallel to the gun barrel axis. Further, the deformation of the images seen by the user looking at the transparent plate could consist in partial or total changes of color. Generally, whatever such deformation, it is sufficient that it should be easily, and preferably immediately, recognizable by the user. The optical art provides many possibilities and varieties of such changes, and all of them are comprised in the scope of the invention. For instance, means are known for printing figures which change their color or their apparent shape, or show or hide various geometrical figures, or become translucent, or show a network of lines, and so on. Any one of these optical means can be used in carrying out the invention. It should be understood that the term "image", as used herein, does not imply figures having a meaning or representing definite objects, but includes any shape of any kind whatsoever, including meaningless and convoluted shapes. Various kinds, shapes and sizes of support could also be used. For example, the element that is shown as a circular frame 36 in FIG. 2B could be cylindrical and of significant length to exclude any optical interference from the outside with the transparent plate, or, on the contrary, could be very thin and even reduced to a small number of circumferential points. It might also be such as to permit the substitution of the transparent plate, since different transparent plates might be preferable under different environmental conditions, or the plate might become damaged and have to be replaced.

The transparent plate may also be implemented as a combination of an air layer and a circular object, e.g., a dye layer. Such combination can be inserted into a narrow through bore, formed in the support, so that anyone looking through it will only see an object that is comprised in a small area around the axis of the bore. In a preferred embodiment, the bore may be circular and the object which is to be seen through it be also circular and with the same diameter as the bore. The relation between the bore depth and the bore diameter determines the sharpness of the transition from a desired orientation with no deformation of the critical image to an undesired orientation with a deformed image.

In order to allow the shooter seeing the image clearly, the dye layer may be an illuminating layer (e.g., a phosphorous material), having a distal wall that is sufficiently immersed in the bore, such that said distal wall is actually the distal wall of the support and is exposed to ambient light when the shooter aims the firearm. During the short time period until shooting, the illuminating layer absorbs ambient light and the dye layer can be well seen by the shooter, both during daytime and nighttime. More illumination toward the shooter's eye can be obtained by using a bore with reflecting walls.

The dye layer may also be self illuminating, by using, for example, electric light source or Tritium.

Figure 4:
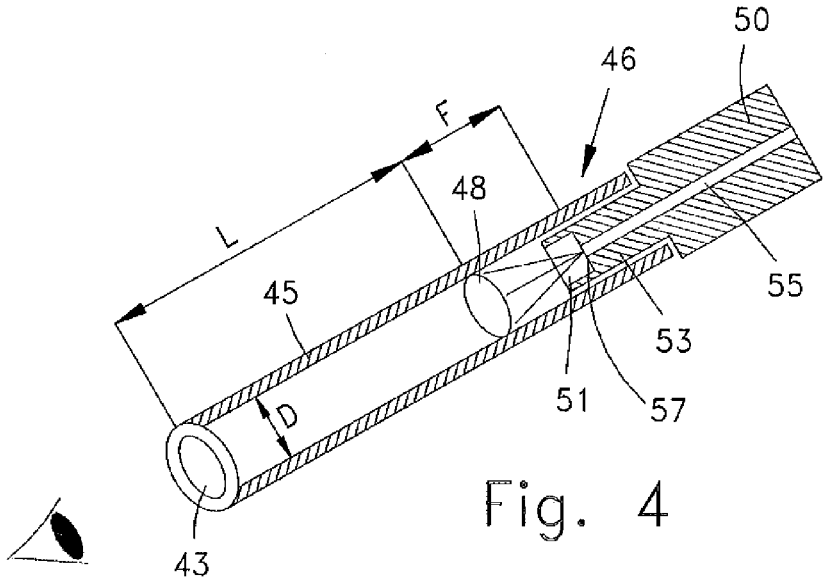
FIG. 4 illustrates a schematic cross sectional view of one embodiment of an aiming device which comprises a single light collecting rod.

FIG. 4 illustrates another embodiment of the invention in which the light source of the transparent plate is a light collecting rod 55. As shown, aiming device 46 comprises tubular plate 45, lens 48, sleeve 50, and light collecting rod 55. Sleeve 50 made of solid transparent material such as Perspex is insertable within tubular plate 45 in the hollow interior of which is mounted lens 48. Plate 45 is attached to the gun barrel in such a way that the axis of plate 45 is parallel to the axis of the gun barrel. Sleeve 50 has a shoulder 53 the outer diameter of which is substantially equal to, or slightly greater than, the inner diameter of plate 45, and therefore sleeve 50 may be attached to plate 45 by a press fit. Light collecting rod 55, which is adapted to collect ambient light transmitted through the solid transparent material of sleeve 50, is positioned within a bore substantially coinciding with the longitudinal axis of both plate 45 and sleeve 50. The proximal end of shoulder 53, i.e. the end closer to the light exit 43 of plate 45, is formed with a recessed portion 51 through which the light collected by rod 55 propagates to plate 45. It will be appreciated that the proximal end of shoulder 53 may also be made of solid transparent material. Lens 48 serving as the image projection element is positioned at a distance F from the proximal end 57 of rod 55, which is substantially equal to the focal length of lens 48, and is positioned at a characteristic distance L from the light exit 43 of plate 45 which is greater than twice the focal length F of lens 48. Thus the light projected from light exiting rod 55 will appear, due to the influence of lens 48, as a critical image occupying the entire bore of plate 45 when the axis of the barrel is parallel to the line of sight. However, when the axis of the barrel is not parallel to the line of sight, the light collecting rod 55 will be partially obstructed by the inner wall of plate 45 and a deformed image will appear at light exit 43.

Since tubular plate 45 is small, the gun supporting tubular plate 45 may be quickly and accurately aimed at a selected target by displacing the gun barrel until the selected target surrounds plate 45 and the critical image, which may be colored, appears throughout the bore of light exit 43. If a deformed image appears in light exit 43, the orientation of plate 45 is changed by slightly displacing the gun barrel until the critical image suddenly appears essentially throughout light exit 43. A predetermined sensitivity transition sharpness from a deformed image to a critical image, or vice versa, may be set by varying diameter D of plate 45 and/or characteristic distance L between lens 48 and light exit 43 of plate 45.

Figure 5:
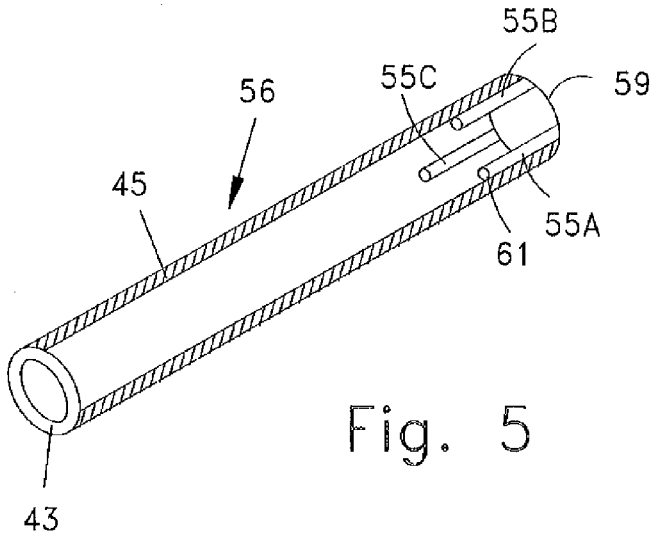
FIG. 5 illustrates a schematic and perspective cross sectional view of one embodiment of an aiming device which comprises a plurality of light collecting rods.
Figure 6:
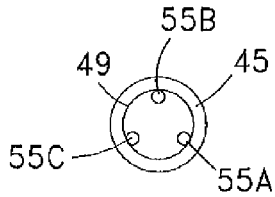
FIG. 6 is a front view of the aiming device of FIG. 5, illustrating a critical image generated thereby.

FIGS. 5 and 6 illustrate another embodiment of the invention adapted to provide increased sensitivity, or transition sharpness from a deformed image to a critical image. Aiming device 56 comprises tubular plate 45 and a plurality of light collecting rods serving as the light source, e.g. three rods 55A-C as illustrated, protruding proximally from the distal end 59 of plate 45. Rods 55A-C are attached to inner wall 49 of plate 45 in such a way that the angular distance between each adjacent rod is substantially equal. Thus a user views a critical image of all three rods 55A-C at proximal end 43 of plate 45 serving as the light exit means when the axis of barrel 45 is parallel to the line of sight. However, when the axis of plate 45 is not parallel to the line of sight, a deformed image appears and one or more of the rods ceases to become visible to the user. The relative location of the one or more of the rods that ceases to become visible is indicative of the direction of deviation of the line of sight from the gun barrel axis. The sensitivity of the aiming device is also dependent upon the diameter of plate 45 and the distance between proximal end 43 of plate 45 and proximal end 61 of rods 55A-C. A predetermined sensitivity may be set by varying the diameter of plate 45 and/or the distance between proximal end 43 of plate 45 and proximal end 61 of rods 55A-C.

Figure 7:
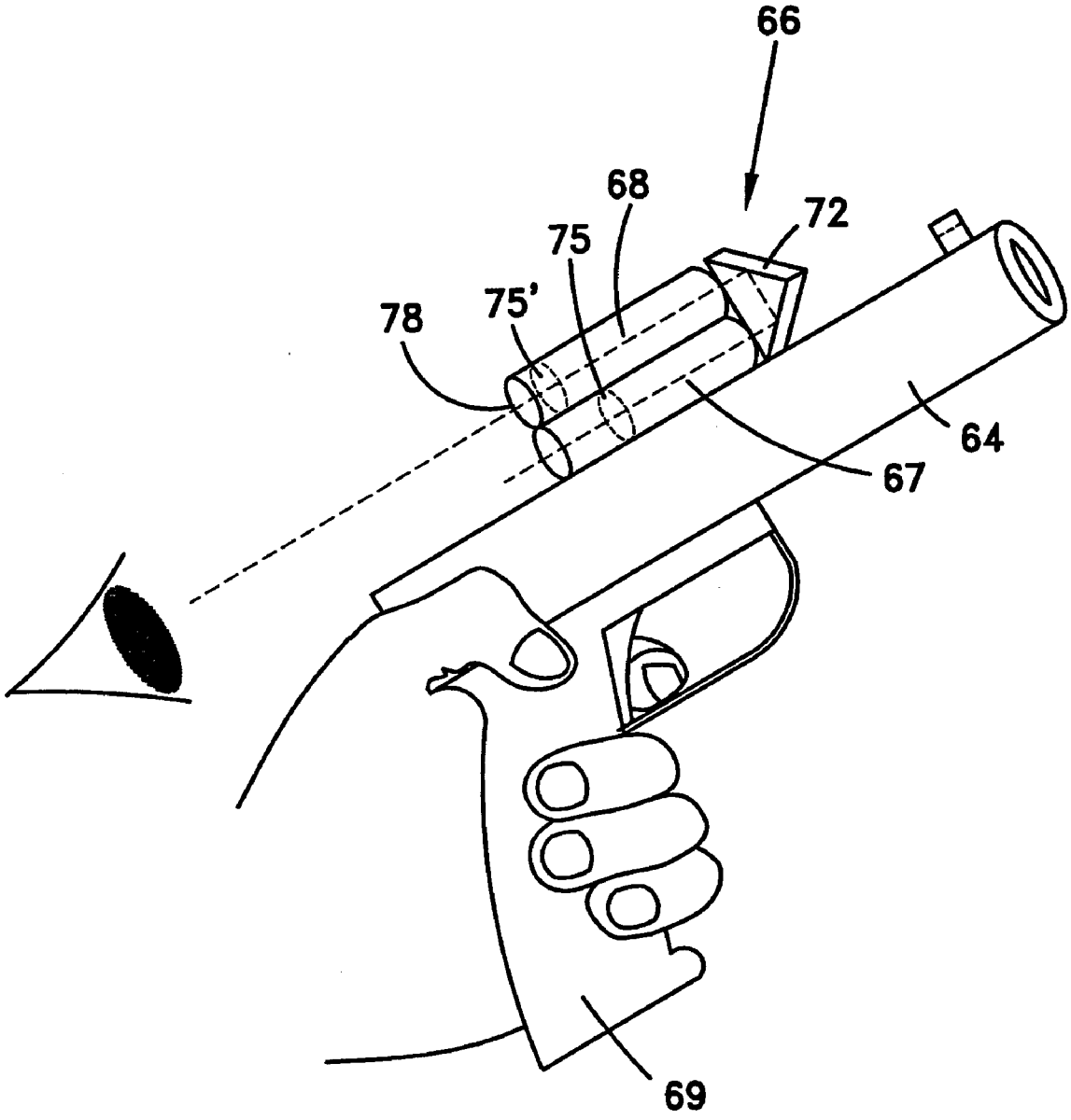
FIG. 7 is a perspective view of another embodiment of an aiming device which comprises a prism.

FIG. 7 illustrates another embodiment of the invention which is suitable for guns having a short barrel. In this embodiment, aiming device 66 comprises two connected tubular plates 67 and 68, and prism 72. The length of plates 67 and 68 is substantially equal. Lower plate 67 is attached to barrel 64 of gun 69, and plates 67 and 68 are oriented in such a way that their axis is parallel to the axis of gun barrel 64. Prism 72 may be attached to barrel 64, or alternatively may be attached to the distal end of plates 67 and 68. Prism 72 may be a Porro prism, or a combination of prism elements, which is adapted to reflect the light that entered lower plate 67 by 180 degrees. Thus image 75, whether a critical image or a deformed image, appears at proximal end 78 of upper plate 68 as reflected image 75'. Due to the light reflection of 180 degrees, plates 67 and 68 function as a light transmission system having a combined characteristic length twice as long as the length of each of plates 67 and 68, and therefore the sensitivity of aiming device 66 is increased.

While embodiments of the invention have been described by way of illustration, it will be apparent that the invention can be carried into practice by persons skilled in the art with many modifications, for example, implementing the aiming device proposed by the present invention for guns that are not firearms, such at toy guns, PaintBall guns and any gun that is intended to shoot a real, dummy or virtual projectile of any shape to a target, variations and adaptations, without departing from the spirit of the invention or exceeding the scope of the claims.

The invention claimed is:

1. Aiming device for guns, which comprises one or more tubular elements supported by a gun barrel for displaying a critical image, each of said one or more tubular elements having— i. a tube configured with a bore having an inner diameter ranging from 3 to 10 mm;

ii. a distally disposed light collecting rod housed within a sleeve made of solid transparent material and attached to said tube;

iii. an annular, proximally disposed end of said tube, through which a user views an image projected from said rod and configured with a diameter substantially equal to that of said tube;

iv. a lens mounted in a tube interior for projecting an image from said rod essentially throughout said proximally disposed end, wherein the distance between a rod proximal end and said lens is substantially equal to the focal length of said lens; and v. a characteristic tube length between said lens and said proximally disposed end of said tube which is greater than twice the focal length of said lens, a critical image appearing essentially throughout said proximally disposed end of said tube when said one or more tubular elements has a predetermined orientation such that the axis of the gun barrel is parallel to the line of sight passing through an eye of the user and a center of said lens, a deformed image appearing in said proximally disposed end of said tube when said one or more tubular elements has an orientation other than said predetermined orientation and the image projected from said lens is partially obstructed by a wall of, or enclosing, said tube, the relative location of said deformed image with respect to said proximally disposed end of said tube being indicative of the direction of deviation of the line of sight from the gun barrel axis, wherein a predetermined transition sharpness from said deformed image to said critical image is defined by said tube inner diameter and said characteristic length.

2. Aiming device according to claim 1, wherein a tubular element longitudinal axis is substantially parallel to the gun barrel axis.

3. Aiming device according to claim 1, further comprising a support for mounting the one or more tubular elements on the gun barrel at a desired orientation.

4. Aiming device according to claim 3, wherein the support comprises a ring-like portion.

5. Aiming device according to claim 1, wherein the one or more tubular elements comprises a gaseous medium which is disposed within a bore formed in the one or more tubular elements.

6. Aiming device according to claim 5, wherein the one or more tubular elements comprises an air layer.

7. Aiming device according to claim 6, wherein the one or more tubular elements further comprises a dye layer for increasing visibility of the images.

8. Aiming device according to claim 7, wherein the dye layer is an illuminating layer exposed to ambient light.

9. Aiming device according to claim 8, wherein the bore formed in the one or more tubular elements has reflecting walls.

10. Aiming device according to claim 8, wherein the dye layer is a self-illuminating layer.

11. Aiming device according to claim 1, wherein the one or more tubular elements is attached to the gun barrel.

12. Aiming device according to claim 1, wherein the predetermined transition sharpness results in the disappearance or appearance of the critical image.

13. Aiming device according to claim 1, wherein the predetermined transition sharpness results in partial or total changes of color.

14. Aiming device according to claim 1, wherein the one or more tubular elements is supported by the barrel of a gun is selected from the group consisting of:

toy guns;

PaintBall guns; and a gun that is intended to shoot a real, dummy or virtual projectile of any shape to a target.

15. Aiming device according to claim 14, wherein the gun is a hand-held gun.

16. Aiming device according to claim 15, wherein the gun is a rifle.

17. Aiming device according to claim 1, further comprising a plurality of optical fibers each of which is housed within the sleeve.

18. Aiming device according to claim 1, wherein the sleeve is formed with a recessed portion through which the light collected by the rod propagates to the lens.

19. Aiming device according to claim 17, wherein a plurality of optical fibers protrude proximally from a tubular element distal end and are attached to a tubular element inner wall in such a way that the angular distance between each adjacent fiber is substantially equal, the relative location of one or more of the fibers that ceases to become visible upon appearance of a deformed image being indicative of the direction of deviation of the line of sight from the gun barrel axis.

20. Aiming device according to claim 2, further comprising a lower tubular element, an upper tubular element connected on top of said lower tubular element, and prism means disposed at the distal end of said upper and lower tubular element, wherein the image projection source is a lower tubular element proximal end and the light exit means is an upper tubular element proximal end, said prism means being adapted to reflect the light received by said lower tubular element by substantially 180 degrees and the characteristic length between the image projection source and the light exit means being substantially equal to twice the length of said lower tubular element.

21. Aiming method for guns, comprising the steps of:

a) providing a gun with one or more tubular elements supported by a gun barrel, each of said one or more tubular elements having— i. a tube configured with a bore having an inner diameter ranging from 3 to 10 mm;

ii. a distally disposed light collecting rod housed within a sleeve made of solid transparent material and attached to said tube;

iii. an annular, proximally disposed end of said tube, through which light exits and a user views an image projected from said rod and configured with a diameter substantially equal to that of said tube;

iv. a lens mounted in a tube interior for projecting an image from said rod essentially throughout said proximally disposed end of said tube, wherein the distance between a rod proximal end and said lens is substantially equal to the focal length of said lens;

v. a characteristic tube length between said lens and said proximally disposed end of said tube which is greater than twice the focal length of said lens and defines a predetermined critical image transition sharpness;

b) aiming the gun at a selected target until said selected target surrounds said one or more tubular elements whereby a critical image appears essentially throughout said proximally disposed end of said tube when said one or more tubular elements has a predetermined orientation such that the axis of the gun barrel is parallel to the line of sight passing through an eye of the user and a center of said lens, and a deformed image appears in said proximally disposed end of said tube when said one or more tubular elements has an orientation other than said predetermined orientation and the object projected from said lens is partially obstructed by a wall of, or enclosing, said or more tubular elements; and if said projected image is a distorted image, changing the orientation of said one or more tubular elements by displacing said barrel until said critical image appears essentially throughout in said proximally disposed end of said tube.

22. Aiming method according to claim 21, wherein the orientation of the one or more tubular elements is changed in a direction parallel to a line passing through the distorted image and a center of the proximally disposed end of said tube.

23. Aiming device according to claim 1, wherein the one or more tubular elements is transparent.

24. Aiming device according to claim 1, wherein the rod generates colored light.

25. Aiming device according to claim 24, wherein a first sleeve in which is housed a first rod that generates a first colored light is replaceable by a second sleeve in which is housed a second rod that generates a second colored light.

26. Aiming device according to claim 1, wherein the rod coincides with a longitudinal axis of both the tube and the sleeve.

* * * * *